US009455108B2

(12) United States Patent
Thomas

(10) Patent No.: US 9,455,108 B2
(45) Date of Patent: Sep. 27, 2016

(54) SHORT CIRCUIT INDICATING DEVICES AND METHODS FOR CIRCUIT BREAKERS

(75) Inventor: Stephen Scott Thomas, Atlanta, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 75 days.

(21) Appl. No.: 14/366,963

(22) PCT Filed: Feb. 29, 2012

(86) PCT No.: PCT/US2012/027088

§ 371 (c)(1),
(2), (4) Date: Oct. 17, 2014

(87) PCT Pub. No.: WO2013/130059

PCT Pub. Date: Sep. 6, 2013

(65) Prior Publication Data

US 2015/0035629 A1 Feb. 5, 2015

(51) Int. Cl.

| | |
|---|---|
| ***H01H 9/20*** | (2006.01) |
| ***H01H 71/12*** | (2006.01) |
| ***H01H 71/04*** | (2006.01) |

(52) U.S. Cl.

CPC ..... *H01H 71/12* (2013.01); *H01H 71/04* (2013.01)

(58) Field of Classification Search

CPC ..... H01H 2071/508; H01H 71/505
USPC ..... 335/167, 168, 171, 10, 21, 18
See application file for complete search history.

(56) References Cited

U.S. PATENT DOCUMENTS

| | | | | |
|---|---|---|---|---|
| 3,070,682 | A | 12/1962 | Starr | |
| 4,713,636 | A * | 12/1987 | Lemmer | H01H 89/08 335/172 |
| 5,343,179 | A * | 8/1994 | Pipich | H01H 71/2463 335/167 |
| 5,886,603 | A * | 3/1999 | Powell | H01H 9/16 200/318 |
| 6,222,433 | B1 * | 4/2001 | Ramakrishnan | H01H 1/2058 200/308 |
| 7,046,108 | B2 * | 5/2006 | Lin | H01H 51/2209 335/132 |
| 7,132,911 | B2 * | 11/2006 | Chung | H01H 83/12 335/166 |
| 2003/0210114 | A1 | 11/2003 | Lin | |
| 2010/0264001 | A1 | 10/2010 | Whitaker | |

OTHER PUBLICATIONS

PCT International Search Report mailed Nov. 23, 2012 corresponding to PCT International Application No. PCT/US2012/027088 filed Feb. 29, 2012 (11 pages).

* cited by examiner

*Primary Examiner* — Alexander Talpalatski

(57) ABSTRACT

A device is provided for use with a circuit breaker that includes a magnetic trip bar adapted to move from a non-tripped position to a tripped position in response to a short-circuit condition, and move from the tripped position to the non-tripped position to reset the circuit breaker. The device includes a slider that has a first position and a second position, and a latch coupled to the magnetic trip bar and the slider. As the magnetic trip bar moves from the non-tripped position to the tripped position, the latch is adapted to move the slider from the first position to the second position to indicate that a short circuit trip has occurred. Numerous other aspects are provided.

24 Claims, 7 Drawing Sheets

SHORT CIRCUIT INDICATING DEVICES AND METHODS FOR CIRCUIT BREAKERS

BACKGROUND

This invention relates generally to circuit breakers, and more particularly to short circuit indicating devices and methods for circuit breakers.

Circuit breakers typically include one or more electrical contacts, and provide protection against persistent overcurrent conditions and short circuit conditions. Some existing circuit breakers include a thermal-magnetic trip unit in which a magnetic trip bar rotates in response to a short circuit fault to trip the circuit breaker and disconnect the electrical contacts. Some existing thermal-magnetic circuit breakers include mechanisms to indicate that a short circuit trip has occurred.

However, such circuit breakers are often costly and complicated to fabricate. Further, such circuit breakers may be reset without requiring manual intervention by a user.

SUMMARY

In a first aspect, a device is provided for use with a circuit breaker that includes a magnetic trip bar adapted to move from a non-tripped position to a tripped position in response to a short-circuit condition, and move from the tripped position to the non-tripped position to reset the circuit breaker. The device includes a slider that has a first position and a second position, and a latch coupled to the magnetic trip bar and the slider. As the magnetic trip bar moves from the non-tripped position to the tripped position, the latch is adapted to move the slider from the first position to the second position to indicate that a short circuit trip has occurred.

In a second aspect, a modular accessory is provided for use with a circuit breaker that includes a magnetic trip bar adapted to move from a non-tripped position to a tripped position in response to a short-circuit condition, and move from the tripped position to the non-tripped position to reset the circuit breaker. The modular accessory includes a slider that has a first position and a second position, and a latch coupled to the magnetic trip bar and the slider. As the magnetic trip bar moves from the non-tripped position to the tripped position, the latch is adapted to move the slider from the first position to the second position to indicate that a short circuit trip has occurred.

In a third aspect, a method is provided for use with a circuit breaker that includes a magnetic trip bar adapted to move from a non-tripped position to a tripped position in response to a short-circuit condition, and move from the tripped position to the non-tripped position to reset the circuit breaker. The method includes providing a slider that has a first position and a second position, and providing a latch coupled to the magnetic trip bar and the slider. As the magnetic trip bar moves from the non-tripped position to the tripped position, the latch moves the slider from the first position to the second position to indicate that a short circuit trip has occurred. Numerous other aspects are provided.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

Some existing circuit breakers include a thermal-magnetic trip unit in which a magnetic trip bar rotates in response to a short circuit fault to trip the circuit breaker and disconnect the electrical contacts. Some existing thermal-magnetic circuit breakers include mechanisms to indicate (e.g., by setting an electronic flag) that a short circuit trip has occurred. However, such circuit breakers are often costly and complicated to fabricate, and may be unnecessary for all applications. Further, although such existing circuit breakers indicate that a short circuit trip has occurred, the circuit breakers often may be reset without requiring manual intervention by a user. This can be extremely dangerous, particularly in instances in which the fault that gave rise to the short circuit has not been resolved before resetting the circuit breaker.

The present invention provides short circuit indicating devices that indicate that a short circuit trip event has occurred and that also prevent resetting the circuit breaker until a user manually resets the short circuit indicating device. Short circuit indicating devices in accordance with this invention include a latch and a slider. The latch is coupled to a magnetic trip bar (e.g., via a magnetic trip bar extension) and to the slider. The slider has a first position and a second position. As the magnetic trip bar moves from the non-tripped position to the tripped position, the latch is adapted to move the slider from the first position to the second position to indicate that a short circuit trip has occurred. When the slider is in the second position, the latch prevents the magnetic trip bar from being reset until a user manually moves the slider from the second position to the first position. Example short circuit indicating devices in accordance with this invention may be implemented as a modular, field-installable accessory.

Figure 1:
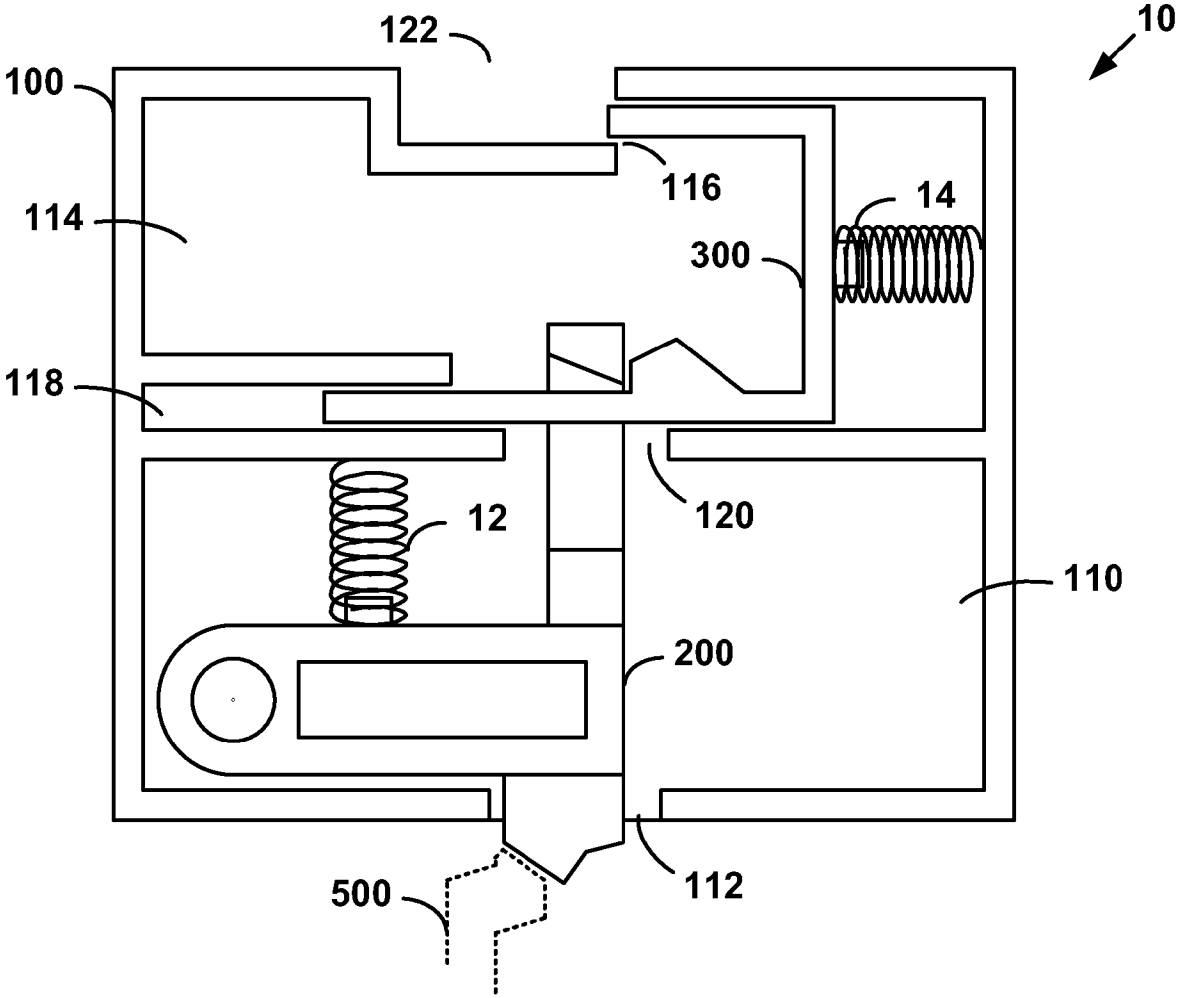
FIG. 1 is a diagram of an example short circuit indicating device in accordance with this invention.

Referring to FIG. 1, an example short circuit indicating device 10 is described. Short circuit indicating device 10 includes a housing 100, a latch 200 and a slider 300. Housing 100 includes a first chamber 110 having a first opening 112, a second chamber 114 having a second opening 116 and a channel 118, a third opening 120 communicatively coupled between first chamber 110 and second chamber 114, and a window 122. Latch 200 is disposed in first chamber 110, and is coupled to a first spring 12. Slider 300 is disposed in second chamber 114, and is coupled to a second spring 14. As described in more detail below, latch 200 is coupled to slider 300 and to a magnetic trip bar (e.g., to a trip bar extension 500 of a magnetic trip bar).

Figure 2B:
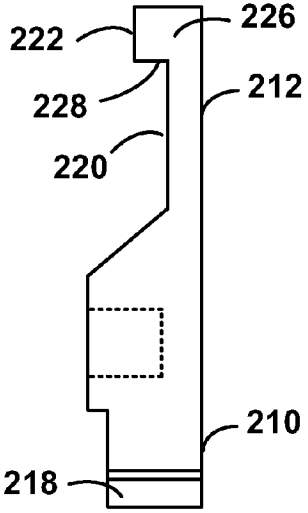
FIGS. 2A and 2B are side and end views of an example latch of a short circuit indicating device in accordance with this invention.
Figure 2A:
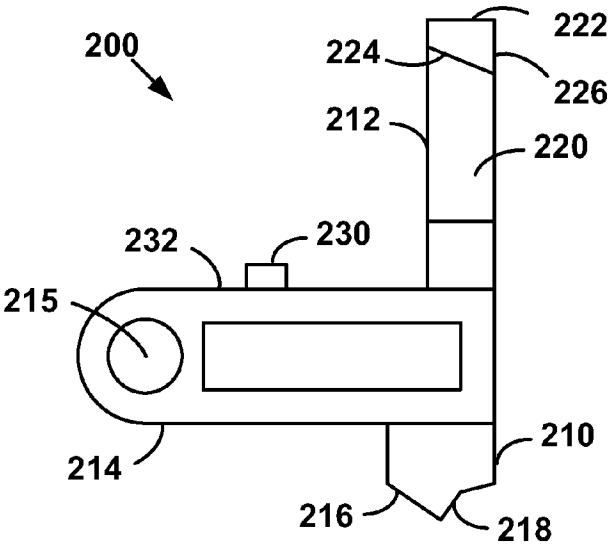

Referring now to FIGS. 2A-2B, example latch 200 is described in more detail. Latch 200 includes a first end 210, a second end 212, a pivot arm 214, and a pivot point 215. First end 210 includes a first beveled surface 216, and a second beveled surface 218. Second end 212 includes a recess 220, and a tab 222 having a third beveled surface 224, an end face 226, and a bottom edge 228. Latch 200 also includes a spring mount 230 disposed on a top surface 232 of pivot arm 214. Latch 200 may be fabricated from metal, plastic, resin, or other similar material, and may be manufactured by machining, injection molding, or other similar technique. Persons of ordinary skill in the art will understand that latch 200 may include components in addition to, or other than those shown in FIGS. 2A-2B.

Figure 3B:
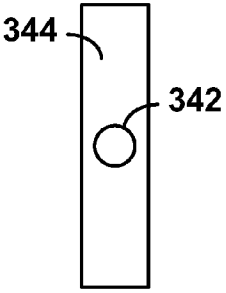
FIGS. 3A and 3B are side and end views of an example slider of an example short circuit indicating device in accordance with this invention.
Figure 3A:
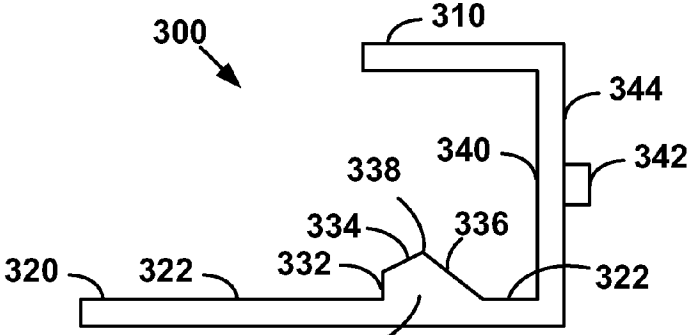

Referring now to FIGS. 3A-3B, example slider 300 is described in more detail. Slider 300 includes a first end 310, a second end 320 and a stop 330 disposed on a top surface 322 of second end 320. Stop 330 includes a first end face 332, a first beveled surface 334, and a second beveled surface 336. First beveled surface 334 and second beveled surface 336 meet at a peak 338. Slider 300 also includes an interior surface 340 and a spring mount 342 disposed on a second end face 344 of slider 300. Slider 300 may be fabricated from metal, plastic, resin, or other similar material, and may be manufactured by machining, injection molding, or other similar technique. Persons of ordinary skill in the art will understand that slider 300 may include components in addition to, or other than those shown in FIGS. 3A-3B.

Figure 4A:
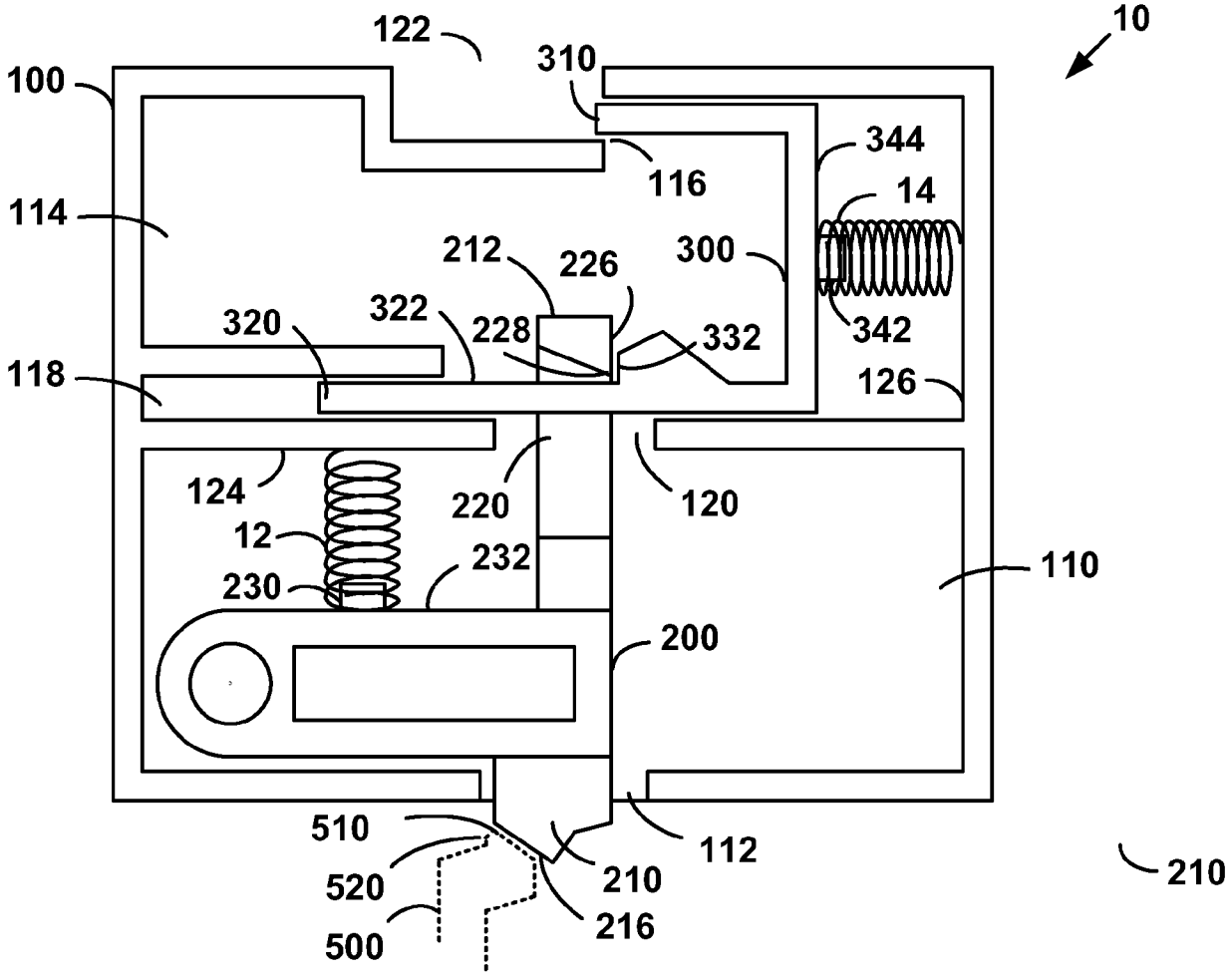
FIG. 4A is a diagram of an example short circuit indicating device in accordance with this invention in a non-trip condition.

Referring now to FIGS. 4A-4E, the operation of short circuit indicating device 10 is now described. FIG. 4A depicts example short circuit indicating device 10 in an initial, non-trip condition. Latch 200 is coupled to slider 300 and to magnetic trip bar extension 500, which includes a first surface 510 and an edge 520. magnetic trip bar extension 500 has a non-tripped position (shown in FIG. 4A), and a tripped position (shown in FIG. 4C, described below).

First end 210 of latch 200 extends through first opening 112 of housing 100, and first beveled surface 216 of first end 210 engages first surface 510 of magnetic trip bar extension 500. Second end 212 of latch 200 extends through third opening 120 into second chamber 114 of housing 100. Second end 320 of slider 300 extends through recess 220 of latch 200 and terminates in channel 118 of housing 100.

First spring 12 is disposed on spring mount 230, and biases top surface 232 of pivot arm 214 in a first (e.g., downward) direction. Second spring 14 is disposed on spring mount 342, and biases second end face 344 of slider 300 in a second (e.g., leftward) direction. Bottom edge 228 of tab 220 engages top surface 322 of slider 300, which prevents movement of latch 200 in the first (downward) direction. Persons of ordinary skill in the art will understand that to reduce friction between latch 200 and slider 300, a stop feature may be provided along a bottom surface of latch 200 so that latch 200 does not impart a full downward load on slider 300. First end face 332 of stop 330 engages end face 226 of tab 220, which prevents movement of slider 300 in the second (leftward) direction.

In this initial, non-trip condition, slider 300 is in a first position. In particular, first end 310 of slider 300 remains substantially within second chamber 114, and does not substantially protrude through second opening 116 into window 122 of housing 100. In this regard, the presence of slider 300 in the first position indicates that a magnetic or short circuit trip event has not occurred.

Figure 4B:
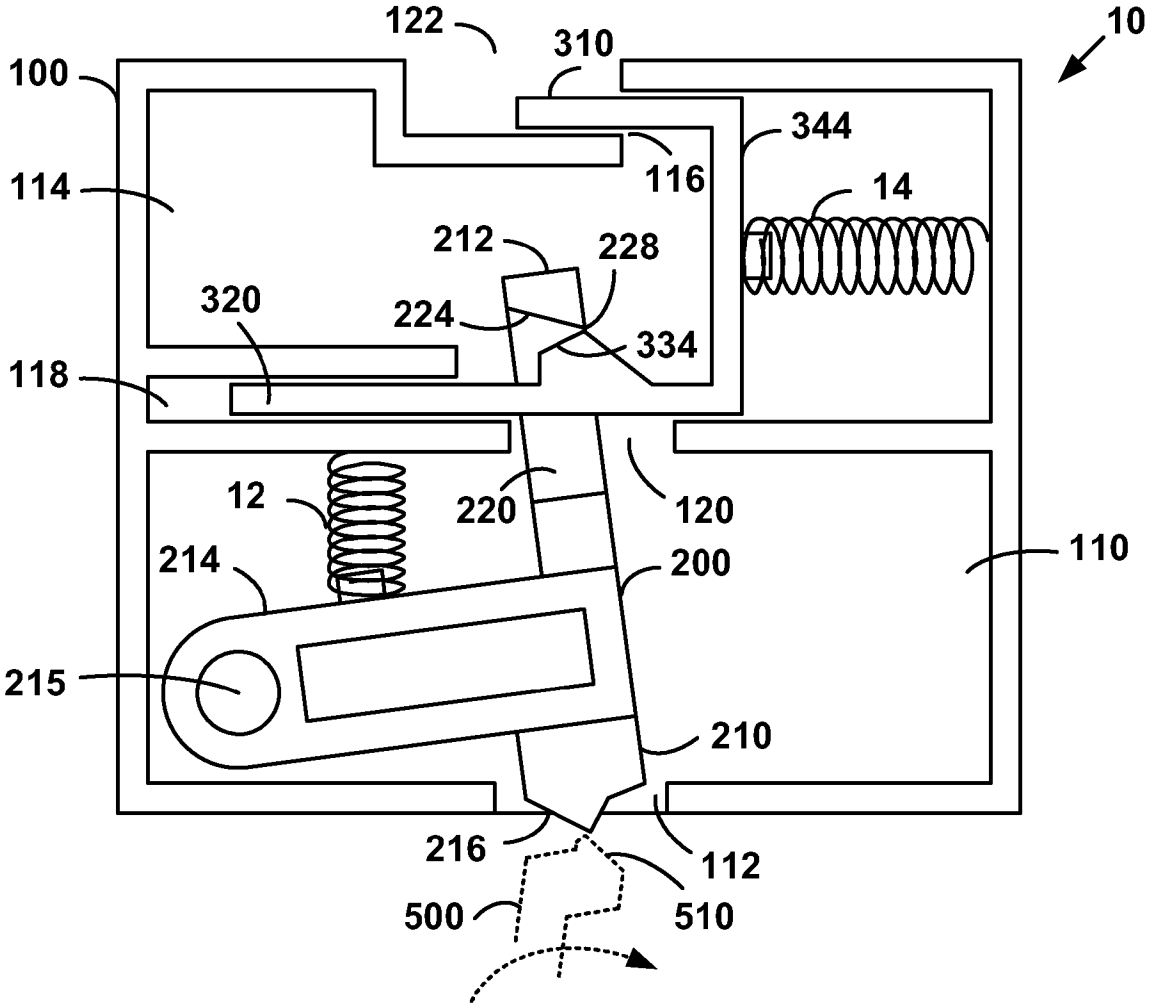
FIG. 4B is a diagram of an example short circuit indicating device in accordance with this invention following a short-circuit trip event.

Referring now to FIG. 4B, the operation of short circuit indicating device 10 following a short-circuit trip event is now described. As indicated by the arrow in FIG. 4B, when a short-circuit trip event occurs, magnetic trip bar extension 500 rotates in a clockwise direction. As a result, first surface 510 of magnetic trip bar extension 500 slidingly engages first beveled surface 216 of latch 200, which causes pivot arm 214 to pivot about pivot point 215 in a counterclockwise direction.

In addition, first end 210 moves upward through first opening 112 into first chamber 110, and second end 212 moves upward through third opening 120 and further into second chamber 114. As first end 210 moves in an upward direction, second spring 14 causes slider 300 to move in the second (leftward) direction, and first end 310 moves through second opening 116 into window 122 of housing. As shown in FIG. 4B, bottom edge 228 rotates up and contacts first beveled surface 334 of stop 330, and then second spring 14 drives stop 330 under tab 222 of latch 200.

Figure 4C:
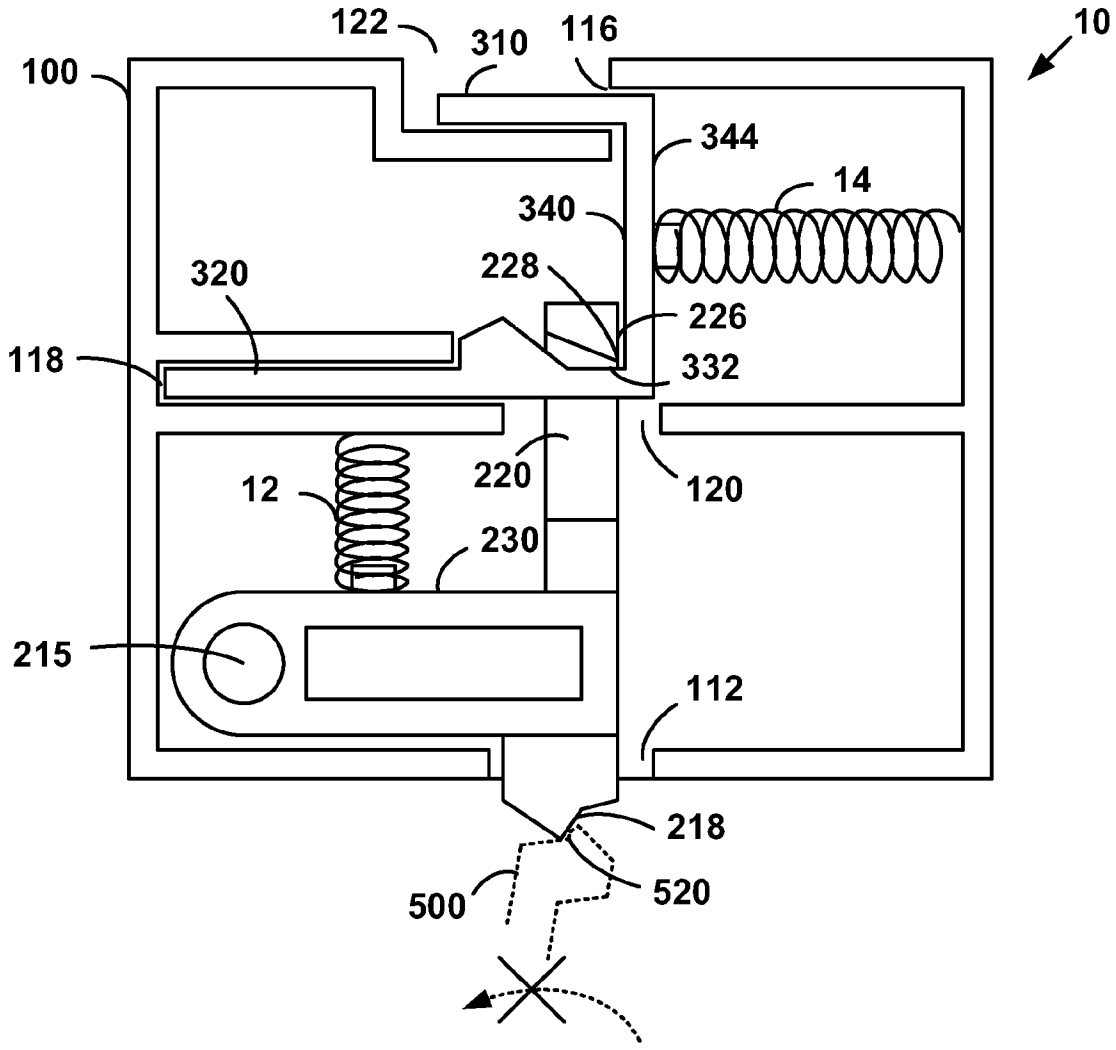
FIG. 4C is a further diagram of an example short circuit indicating device in accordance with this invention following a short-circuit trip event.

As shown in FIG. 4C, second spring 14 causes slider 300 to move in the second (leftward) direction, and first end 310 moves through second opening 116 into window 122 of housing. As this occurs, first spring 12 biases pivot arm 214 clockwise in the first (downward) direction. Bottom edge 228 of tab 220 engages top surface 322 of slider 300, which prevents further movement of latch 200 in the first (downward) direction.

In addition, interior surface 340 of slider 300 engages end face 226 of tab 220, which prevents further movement of slider 300 in the second (leftward) direction. In this configuration, slider 300 is in a second position, with first end 310 substantially fully disposed in window 122 of housing 100. First end 310 may include indicia (not shown) to indicate that may be visible to a user through window 122. The indicia may include a warning label (e.g., "WARNING-SHORT CIRCUIT FAULT"), a warning mark (e.g., a red flag), or some other indicia to visually indicate that a short circuit trip event has occurred.

In addition, as shown in FIG. 4C, second beveled surface 218 of latch 200 engages edge 520 of magnetic trip bar extension 500, which prevents the circuit breaker from being reset. That is, with slider 300 in the second position, indicating that a short-circuit trip event has occurred, latch 200 prevents movement of magnetic trip bar extension 500 to its original (non-tripped) position, and thus prevents a user from resetting the circuit breaker.

Figure 4D:
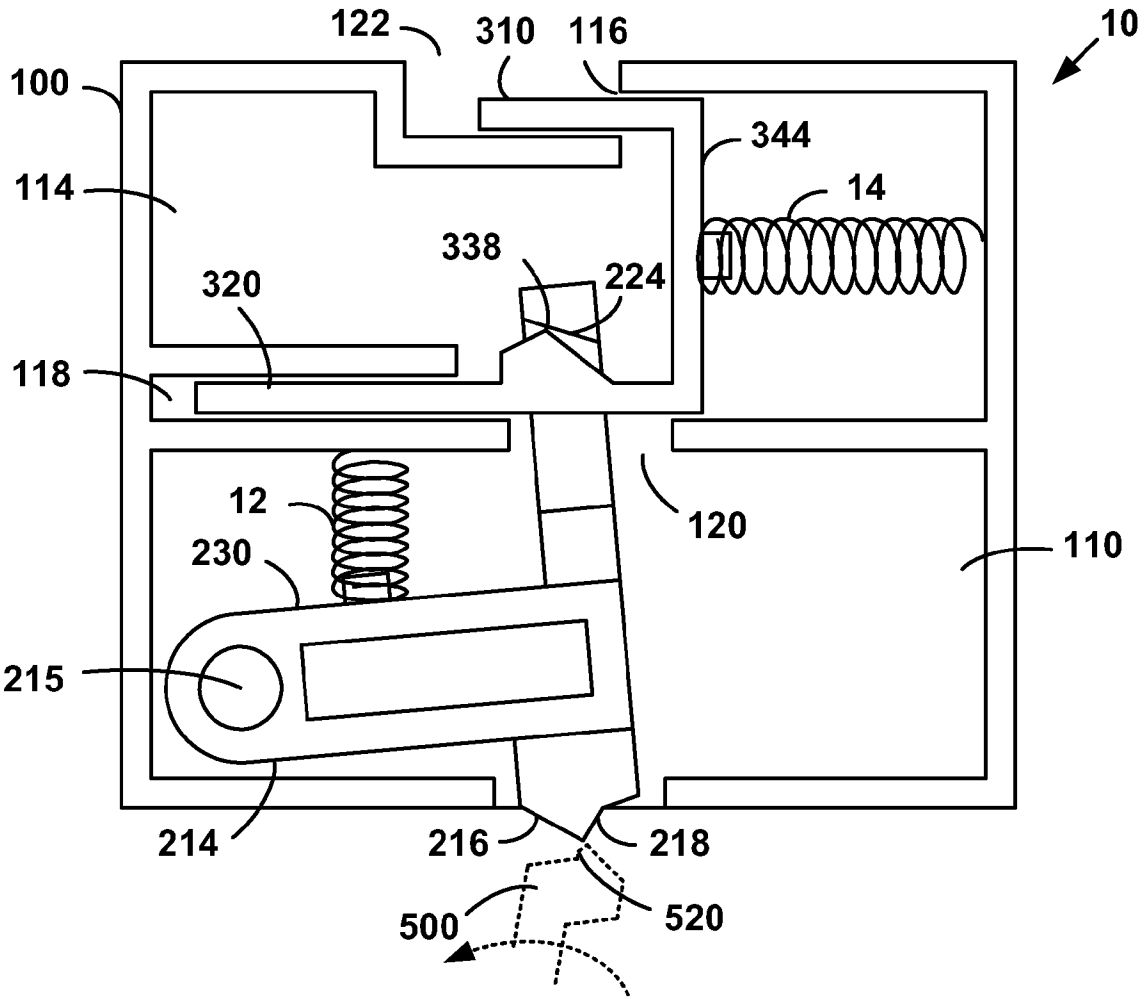
FIG. 4D is a diagram of short circuit indicating devices in accordance with this invention being manually reset.
Figure 4E:
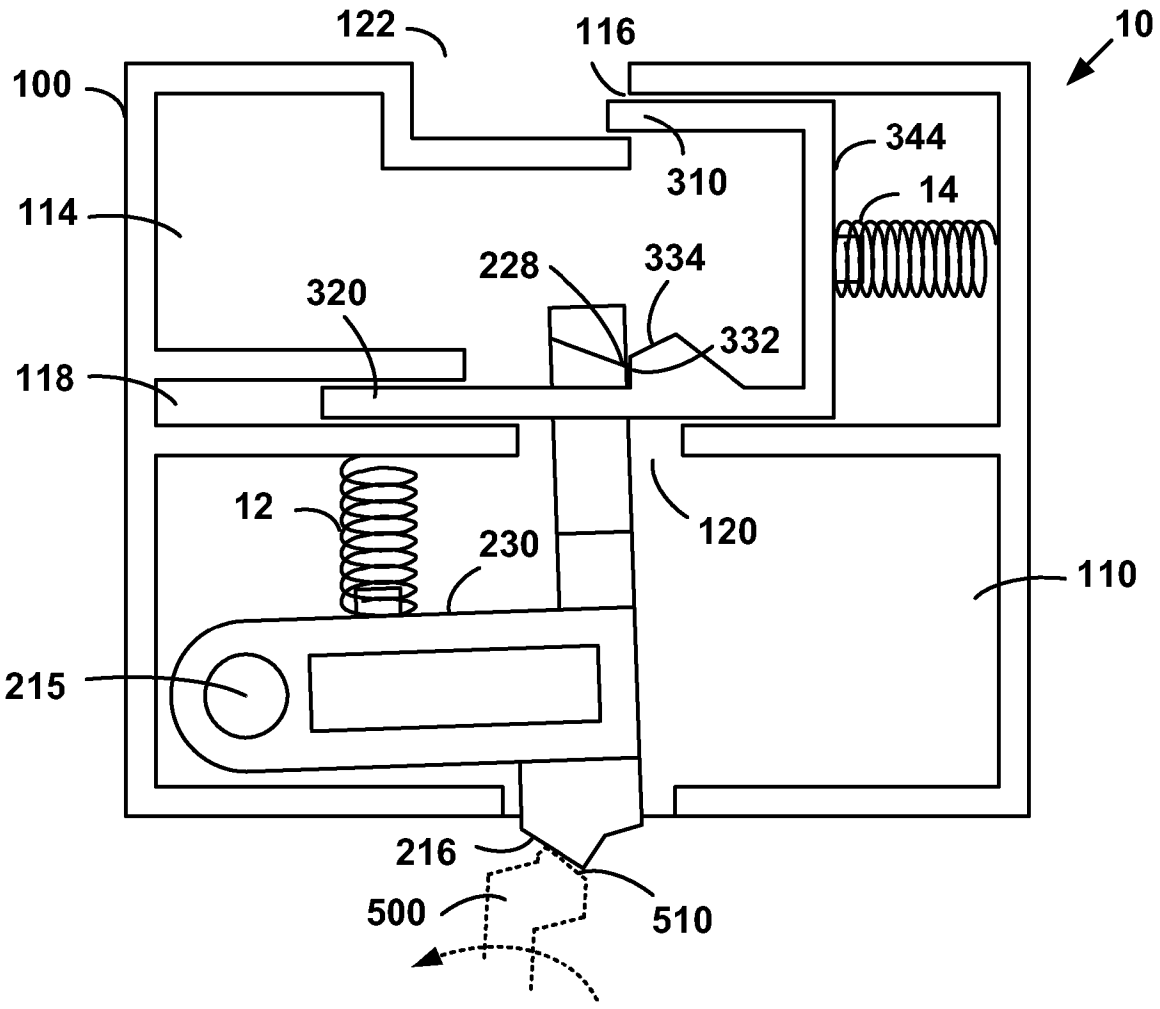
FIG. 4E is a further diagram of short circuit indicating devices in accordance with this invention being manually reset.

To reset the circuit breaker, a user must first manually reset slider 300 from the second position to the first position. In particular, as shown in FIGS. 4D-4E, if a user manually pushes first end 310 of slider 300 in a third (e.g., rightward) direction, first end 310 moves through second opening 116 into second chamber 114 of housing 100. As this occurs, third beveled surface 224 of tab 222 slidingly engages peak 338 of stop 330, which causes pivot arm 214 to rotate in a counterclockwise direction on pivot point 215. As pivot arm 214 rotates, second beveled surface 218 of latch 200 disengages edge 520 of magnetic trip bar extension 500, which allows magnetic trip bar extension 500 to rotate counterclockwise and return to its original position, thereby allowing the circuit breaker to be reset.

As shown in FIG. 4E, when bottom edge 228 of tab 222 clears first beveled surface 334 of stop 330, first spring 12 biases pivot arm 214 clockwise in the first (downward) direction. Bottom edge 228 of tab 220 engages top surface 322 of slider 300, which prevents further movement of latch 200 in the first (downward) direction. As latch 200 returns to its initial position, first beveled surface again engages first surface 510 of magnetic trip bar extension 500.

As described above, example short circuit indicating device 10 may be used to indicate that a short circuit trip event has occurred and also prevent resetting the circuit breaker until a user manually resets slider 300.

Persons of ordinary skill in the art will understand that short circuit indicating devices in accordance with this invention may include additional features not described above. In addition, short circuit indicating devices in accordance with this invention may be designed with physical features and dimensions other than that shown in the illustrated example embodiment.

In addition, persons of ordinary skill in the art will understand that short circuit indicating devices in accordance with this invention may be configured as modular, field-installable accessories for use with circuit breakers, such as circuit breakers that include thermal-magnetic trip devices.

The foregoing merely illustrates the principles of this invention, and various modifications can be made by persons of ordinary skill in the art without departing from the scope and spirit of this invention.

The invention claimed is:

1. A device for use with a circuit breaker that includes a magnetic trip bar adapted to move from a non-tripped position to a tripped position in response to a short-circuit condition, and move from the tripped position to the non-tripped position to reset the circuit breaker, the device comprising:

a magnetic trip bar extension of the magnetic trip bar having an edge and a first surface, wherein when a short-circuit trip event occurs, the magnetic trip bar extension rotates in a clockwise direction;

a housing having a window to visually indicate presence or absence of a magnetic or short circuit trip event;

a slider that comprises a first position and a second position, wherein the slider is disposed in the housing, the slider having a first end visible through the window when the slider is in the second position to visually indicate that the magnetic or short circuit trip event has occurred and with an absence of the first end of the slider into the window when the slider is in the first position to visually indicate that the magnetic or short circuit trip event has not occurred; and a latch coupled to the magnetic trip bar and the slider, wherein as the magnetic trip bar moves from the non-tripped position to the tripped position, the latch is adapted to move the slider from the first position to the second position to indicate that a short circuit trip has occurred, wherein the latch is configured to prevent the magnetic trip bar from being reset until the slider is manually moved from the second position to the first position, wherein the latch includes a first end and a second end, the first end includes a first beveled surface and a second beveled surface, the second end includes a tab having a third beveled surface, wherein when the short-circuit trip event occurs the first surface of the magnetic trip bar extension slidingly engages the first beveled surface of the latch, the second beveled surface of the latch engages the edge of the magnetic trip bar extension, which prevents the circuit breaker from being reset and wherein if a user manually pushes the slider, the third beveled surface causes the second beveled surface of the latch to disengage the edge of the magnetic trip bar extension, which allows the magnetic trip bar extension to rotate counterclockwise and return to its original position, thereby allowing the circuit breaker to be reset.

2. The device of claim 1, wherein when the slider is in the second position, the slider is adapted to engage the latch to hold the magnetic trip bar in the tripped position.

3. The device of claim 1, wherein when a user moves the slider from the second position to the first position, the slider is adapted to engage the latch to release the magnetic trip bar, allowing the magnetic trip bar to return from the tripped position to the non-tripped position.

4. The device of claim 1, wherein the latch comprises a first end coupled to the magnetic trip bar, a second end coupled to the slider, and a pivot point.

5. The device of claim 4, wherein the first end of the latch is adapted to engage the magnetic trip bar.

6. The device of claim 1, wherein:

the slider comprises a stop; and the latch comprises a tab adapted to engage the stop.

7. The device of claim 6, wherein as the magnetic trip bar moves from the non-tripped position to the tripped position, the latch is adapted to pivot, allowing the stop to slide in a first direction.

8. The device of claim 6, wherein as the slider moves from the second position to the first position, the latch is adapted to pivot, allowing the stop to slide in a second direction.

9. A modular accessory for use with a circuit breaker that includes a magnetic trip bar adapted to move from a non-tripped position to a tripped position in response to a short-circuit condition, and move from the tripped position to the non-tripped position to reset the circuit breaker, the modular accessory comprising:

a magnetic trip bar extension of the magnetic trip bar having an edge and a first surface, wherein when a short-circuit trip event occurs, the magnetic trip bar extension rotates in a clockwise direction;

a housing having a window to visually indicate presence or absence of a magnetic or short circuit trip event;

a slider that comprises a first position and a second position, wherein the slider is disposed in the housing, the slider having a first end visible through the window when the slider is in the second position to visually indicate that the magnetic or short circuit trip event has occurred and with an absence of the first end of the slider into the window when the slider is in the first position to visually indicate that the magnetic or short circuit trip event has not occurred; and a latch coupled to the magnetic trip bar and the slider, wherein as the magnetic trip bar moves from the non-tripped position to the tripped position, the latch is adapted to move the slider from the first position to the second position to indicate that a short circuit trip has occurred, wherein the latch is configured to prevent the magnetic trip bar from being reset until the slider is manually moved from the second position to the first position, wherein the latch includes a first end and a second end, the first end includes a first beveled surface and a second beveled surface, the second end includes a tab having a third beveled surface, wherein when the short-circuit trip event occurs the first surface of the magnetic trip bar extension slidingly engages the first beveled surface of the latch, the second beveled surface of the latch engages the edge of the magnetic trip bar extension, which prevents the circuit breaker from being reset and wherein if a user manually pushes the slider, the third beveled surface causes the second beveled surface of the latch to disengage the edge of the magnetic trip bar extension, which allows the magnetic trip bar extension to rotate counterclockwise and return to its original position, thereby allowing the circuit breaker to be reset.

10. The modular accessory of claim 9, wherein when the slider is in the second position, the slider is adapted to engage the latch to hold the magnetic trip bar in the tripped position.

11. The modular accessory of claim 9, wherein when a user moves the slider from the second position to the first position, the slider is adapted to engage the latch to release the magnetic trip bar, allowing the magnetic trip bar to return from the tripped position to the non-tripped position.

12. The modular accessory of claim 9, wherein the latch comprises a first end coupled to the magnetic trip bar, a second end coupled to the slider, and a pivot point.

13. The modular accessory of claim 12, wherein the first end of the latch is adapted to engage the magnetic trip bar.

14. The modular accessory of claim 9, wherein:

the slider comprises a stop; and the latch comprises a tab adapted to engage the stop.

15. The modular accessory of claim 14, wherein as the magnetic trip bar moves from the non-tripped position to the tripped position, the latch is adapted to pivot, allowing the stop to slide in a first direction.

16. The modular accessory of claim 14, wherein as the slider moves from the second position to the first position, the latch is adapted to pivot, allowing the stop to slide in a second direction.

17. A method for use with a circuit breaker that includes a magnetic trip bar adapted to move from a non-tripped position to a tripped position in response to a short-circuit condition, and move from the tripped position to the non-tripped position to reset the circuit breaker, the method comprising:

providing a magnetic trip bar extension of the magnetic trip bar having an edge and a first surface, wherein when a short-circuit trip event occurs, the magnetic trip bar extension rotates in a clockwise direction;

providing a housing having a window to visually indicate presence or absence of a magnetic or short circuit trip event;

providing a slider that comprises a first position and a second position, wherein the slider is disposed in the housing, the slider having a first end visible through the window when the slider is in the second position to visually indicate that the magnetic or short circuit trip event has occurred and with an absence of the first end of the slider into the window when the slider is in the first position to visually indicate that the magnetic or short circuit trip event has not occurred;

providing a latch coupled to the magnetic trip bar and the slider; and as the magnetic trip bar moves from the non-tripped position to the tripped position, causing the latch to move the slider from the first position to the second position to indicate that a short circuit trip has occurred, wherein the latch is configured to prevent the magnetic trip bar from being reset until the slider is manually moved from the second position to the first position, wherein the latch includes a first end and a second end, the first end includes a first beveled surface and a second beveled surface, the second end includes a tab having a third beveled surface, wherein when the short-circuit trip event occurs the first surface of the magnetic trip bar extension slidingly engages the first beveled surface of the latch, the second beveled surface of the latch engages the edge of the magnetic trip bar extension, which prevents the circuit breaker from being reset and wherein if a user manually pushes the slider, the third beveled surface causes the second beveled surface of the latch to disengage the edge of the magnetic trip bar extension, which allows the magnetic trip bar extension to rotate counterclockwise and return to its original position, thereby allowing the circuit breaker to be reset.

18. The method of claim 17, wherein when the slider is in the second position, causing the slider to engage the latch to hold the magnetic trip bar in the tripped position.

19. The method of claim 17, wherein when a user moves the slider from the second position to the first position, causing the slider to engage the latch to release the magnetic trip bar, allowing the magnetic trip bar to return from the tripped position to the non-tripped position.

20. The method of claim 17, further comprising providing the latch with a first end coupled to the magnetic trip bar, a second end coupled to the slider, and a pivot point.

21. The method of claim 20, further comprising engaging the first end of the latch with the magnetic trip bar.

22. The method of claim 17, further comprising:

providing the slider with a stop; and providing the latch with a tab adapted to engage the stop.

23. The method of claim 22, further comprising as the magnetic trip bar moves from the non-tripped position to the tripped position, pivoting the latch to allow the stop to slide in a first direction.

24. The method of claim 22, further comprising as the slider moves from the second position to the first position, pivoting the latch to allow the stop to slide in a second direction.

* * * * *